US007520824B2

(12) United States Patent
Kasashima

(10) Patent No.: US 7,520,824 B2
(45) Date of Patent: Apr. 21, 2009

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/322,652

(22) Filed: Dec. 19, 2002

(65) Prior Publication Data

US 2003/0134695 A1 Jul. 17, 2003

(30) Foreign Application Priority Data

Dec. 28, 2001 (JP) ..... 2001-401144

(51) Int. Cl.
*A63B 37/14* (2006.01)

(52) U.S. Cl. ..... 473/384

(58) Field of Classification Search ..... 473/379–384, 473/378

See application file for complete search history.

(56) References Cited

U.S. PATENT DOCUMENTS

| | | | | |
|---|---|---|---|---|
| 4,720,111 | A * | 1/1988 | Yamada | 473/382 |
| 4,804,189 | A * | 2/1989 | Gobush | 473/384 |
| 4,949,976 | A * | 8/1990 | Gobush | 473/379 |
| 4,960,283 | A * | 10/1990 | Gobush | 473/384 |
| 5,024,444 | A * | 6/1991 | Yamagishi et al. | 473/384 |
| 5,090,705 | A * | 2/1992 | Oka et al. | 473/384 |
| 5,123,652 | A * | 6/1992 | Oka | 473/384 |
| 5,145,180 | A * | 9/1992 | Oka | 473/382 |
| 5,156,404 | A * | 10/1992 | Oka et al. | 473/382 |
| 5,722,903 | A * | 3/1998 | Moriyama et al. | 473/384 |
| 5,827,135 | A * | 10/1998 | Shimosaka et al. | 473/379 |
| 5,906,551 | A * | 5/1999 | Kasashima et al. | 473/384 |
| 6,039,660 | A * | 3/2000 | Kasashima et al. | 473/378 |
| 6,066,055 | A * | 5/2000 | Nishino | 473/384 |
| 6,234,917 | B1 | 5/2001 | Asakura | |
| 6,390,938 | B1 | 5/2002 | Asakura et al. | |
| 6,530,850 | B2 * | 3/2003 | Sajima | 473/382 |
| 6,540,625 | B2 * | 4/2003 | Sajima | 473/383 |
| 6,632,148 | B2 * | 10/2003 | Hayashi et al. | 473/374 |
| 6,821,215 | B2 * | 11/2004 | Sajima | 473/382 |

FOREIGN PATENT DOCUMENTS

| | | | |
|---|---|---|---|
| JP | 03-140168 | A | 6/1991 |
| JP | 06-218076 | A | 8/1994 |
| JP | 2838963 | B2 | 10/1998 |
| JP | 11137721 | A * | 5/1999 |
| JP | 2000-325499 | A | 11/2000 |
| JP | 2001212260 | A * | 8/2001 |

* cited by examiner

*Primary Examiner*—Alvin A Hunter
(74) *Attorney, Agent, or Firm*—Sughrue Mion, PLLC

(57) ABSTRACT

A golf ball includes a multiplicity of dimples on a spherical surface of the golf ball. The dimples are rotation-symmetric of a specific angle about a rotational axis which connects both poles of the golf ball to each other while passing through the center of an equatorial plane of the golf ball, and any great circle line not crossing any one of the dimples is not present on the spherical surface of the golf ball. The golf ball is excellent in flight distance and flight uniformity.

14 Claims, 11 Drawing Sheets

GOLF BALL

BACKGROUND OF THE INVENTION

The present invention relates to a golf ball excellent in flight performance and flight uniformity.

A multiplicity of dimples are generally arranged on the surface of a golf ball. Since the arrangement of these dimples exerts a large effect on flight performance of the golf ball, various attempts have been made to improve the shapes of the dimples and the arrangement of the dimples. For example, there has been adopted a dimple arrangement method including the steps of taking the spherical surface of the ball as a polyhedron such as an icosahedron, a dodecahedron, or an octahedron, uniformly dividing the polyhedron into polygons such as triangles, and uniformly arranging a plurality of kinds of dimples on each of the polygons as a unit, thereby uniformly arranging the dimples over the spherical surface of the ball.

Such a dimple arrangement method is effective from the viewpoint of uniformly arranging dimples on the spherical surface of a golf ball; however, it has a problem that the degree of freedom in dimple arrangement is not sufficiently large. To be more specific, since the dimples must be uniformly arranged in each of polygonal units divided from the spherical surface of the ball, there is a limitation in arrangement of the dimples in each of the polygonal units.

On the other hand, in producing a golf ball by injection molding, to form dimples on the surface of the ball, a large number of projections for forming the dimples must be provided on the inner wall of a cavity of a mold composed of upper and lower mold halves. In this case, since the parting plane of upper and lower mold halves is generally set to correspond to the equatorial plane of the ball formed by the cavity of the mold, it is difficult to form the dimples directly on the equator of the ball, and therefore, the projections for forming the dimples are generally not provided on the mold parting plane.

In the case of providing projections for forming dimples on a mold parting plane, the shapes of the dimples may be degraded when part of a golf ball molding material cured in a number of injection gates provided at positions of the mold parting plane is removed by polishing or the like. The provision of projections for forming dimples at positions on a mold parting plane may cause another problem in raising the cost required for design and production of the mold, and complicating the work of producing the mold.

Accordingly, projections for forming dimples are generally provided at positions out of a mold parting plane, with a result that an endless stripe-like land portion with no dimple is formed along the equator line of a golf ball, and thereby the continuation of the dimple arrangement is cutoff by the equator line of the golf ball, thereby making it difficult to continuously, densely form the dimples over the surface of the golf ball.

In the case of using a golf ball having such a dimple arrangement, the rotations of the golf ball differs depending on a position of the ball hit with a golf club. For example, the flight distance of the golf ball may greatly differ between the case of rotating the ball about a center axis connecting both the poles of the ball to each other and the case of rotating the ball about an axis extending in the direction perpendicular to the center axis. The golf ball having the above-described dimple arrangement may cause, in addition to a problem associated with a variation in flight distance, another problem that the ball is deviated rightwardly or leftwardly depending on the hitting position of the golf ball, failing to sufficiently obtain the direction stability of the ball.

SUMMARY OF THE INVENTION

In view of the foregoing, the present invention has been made, and an object of the present invention is to provide a golf ball capable of making a variation in flight distance due to a hitting position of the golf ball as small as possible, and enhancing the symmetry of flight and the flight distance of the golf ball.

To achieve the above object, the present inventor has studied, especially, about the dimples arranged on the surface of a golf ball, and found that by arranging dimples on the surface of the ball in such a manner that the dimples are rotation-symmetric of a specific angle of 360°/n (n: natural number), for example, 60°, 72°, 90°, 120°, or 180° about a rotational axis connecting both the poles of the ball to each other while passing through the center of the equatorial plane of the ball, it is possible to make a variation in flight distance due to a hitting position of the ball as small as possible, and to obtain a sufficient flight distance while keeping a high symmetry of flight. On the basis of such knowledge, the present invention having the following configurations has been accomplished.

To achieve the above object, according to an aspect of the present invention, there is provided a golf ball including: a multiplicity of dimples on a spherical surface of the golf ball; wherein the dimples are rotation-symmetric of a specific angle about a rotational axis which connects both poles of the golf ball to each other while passing through the center of an equatorial plane of the golf ball; and any great circle line not crossing any one of the dimples is not present on the spherical surface of the golf ball.

The dimples may be 60° rotation-symmetric about the rotational axis.

The dimples may be also 72° rotation-symmetric about the rotational axis.

The dimples may be also 90° rotation-symmetric about the rotational axis.

The dimples may be also 120° rotation-symmetric about the rotational axis.

The dimples may be also 180° rotation-symmetric about the rotational axis.

In the golf ball, assuming that longitude lines extending from each of the poles to the equator of the ball are taken as virtual circular-arcs, the dimples are preferably linear-symmetric with respect to each of the circular-arcs.

The circular-arcs of the number of 12 may be arranged on the hemispherical surface of the ball in such a manner as to be spaced from each other at intervals of 30°.

The circular-arcs of the number of 10 may be also arranged on the hemispherical surface of the ball in such a manner as to be spaced from each other at intervals of 36°.

The circular-arcs of the number of 8 may be also arranged on the hemispherical surface of the ball in such a manner as to be spaced from each other at intervals of 45°.

The circular-arcs of the number of 6 may be also arranged on the hemispherical surface of the ball in such a manner as to be spaced from each other at intervals of 60°.

The circular-arcs of the number of 4 may be also arranged on the hemispherical surface of the ball in such a manner as to be spaced from each other at intervals of 90°.

The number of the dimples crossing the equator may be in a range of 4 to 32.

Part of the dimples crossing the equator may be formed, at the time of formation of the ball, by mold halves having a parting portion curved in projections and depressions along the edges of the dimples.

BRIEF DESCRIPTION OF THE DRAWINGS

Other features and advantages of the present invention will be apparent from the following description taken in conjunction with the accompanying drawings wherein.

DETAILED DESCRIPTION OF THE PREFERRED EMBODIMENTS

The present invention will be hereinafter described in more detail with reference to the drawings.

Figure 1:
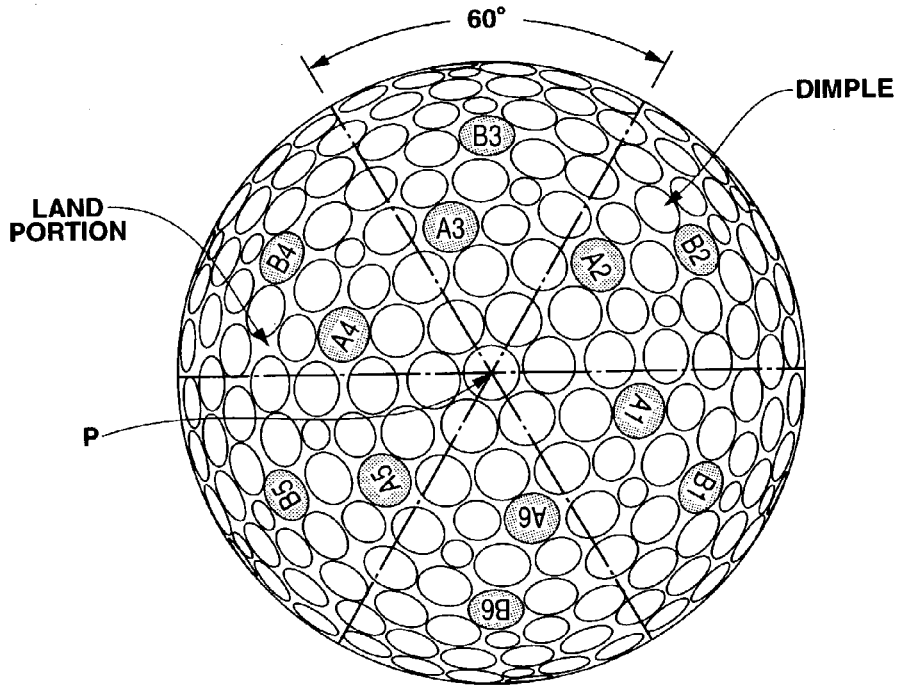
FIG. 1 is a plan view, seen from the pole side, of a golf ball according to a first embodiment of the present invention.
Figure 2:
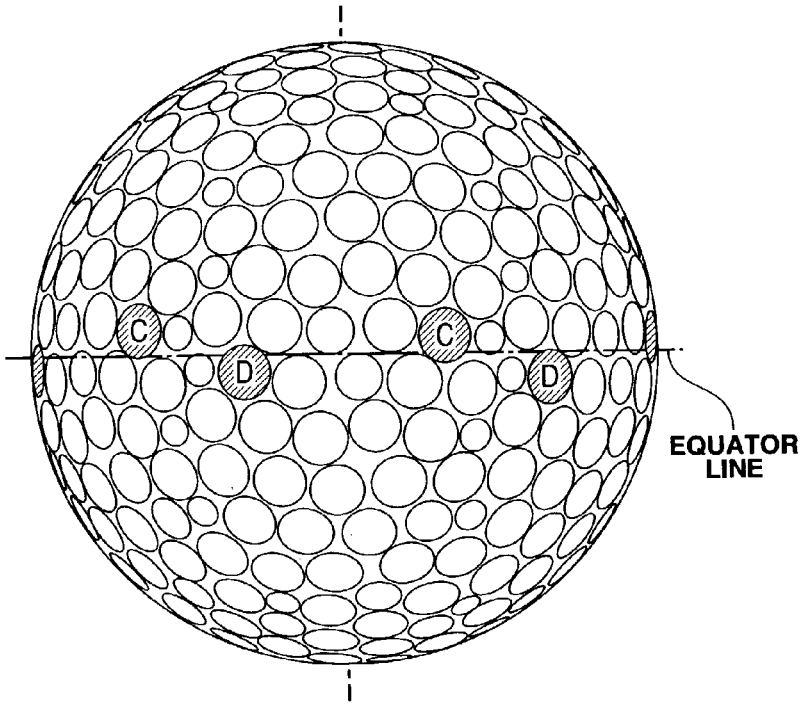
FIG. 2 is a side view, seen from the equator side, of the golf ball shown in FIG. 1.

FIG. 1 is a plan view, seen from the pole side, of a golf ball according to a first embodiment of the present invention, and FIG. 2 is a side view, seen from the equator side, of the golf ball shown in FIG. 1.

The golf ball according to the first embodiment is specified such that a plurality of kinds of dimples, different from each other in diameter, are arranged in such a manner as to be symmetric about a straight line connecting both the poles of the ball to each other while passing through the center of an equatorial plane of the ball (this straight line is hereinafter referred to as "rotational axis"). For example, dimples $A_1$ to $A_6$ shown as hatched in FIG. 1, which are located at the same latitude line (not shown), are spaced from each other at intervals of 60° about the rotational axis.

Accordingly, the dimples $A_1$ to $A_6$ are arranged in such a manner as to be 60° rotation-symmetric about the rotational axis shown in FIG. 2. In this case, the dimples $A_1$ and $A_4$, $A_2$ and $A_5$, and $A_3$ and $A_6$ are respectively point-symmetric (that is, different from each other by 180°) about the rotational axis seen as a point in the plan view of FIG. 1. Like the dimples $A_1$ to $A_6$, dimples $B_1$ to $B_6$ are 60° rotation-symmetric about the rotational axis, and further, dimples C and dimples D, each of which partially crosses the equator line (the equator line is equivalent to the equator, which is the same below.) as shown in FIG. 2, are 60° rotation-symmetric about the rotational axis. In this embodiment, all of the dimples excluding the dimples located at both the poles are 60° rotation-symmetric about the rotational axis.

Figure 3:
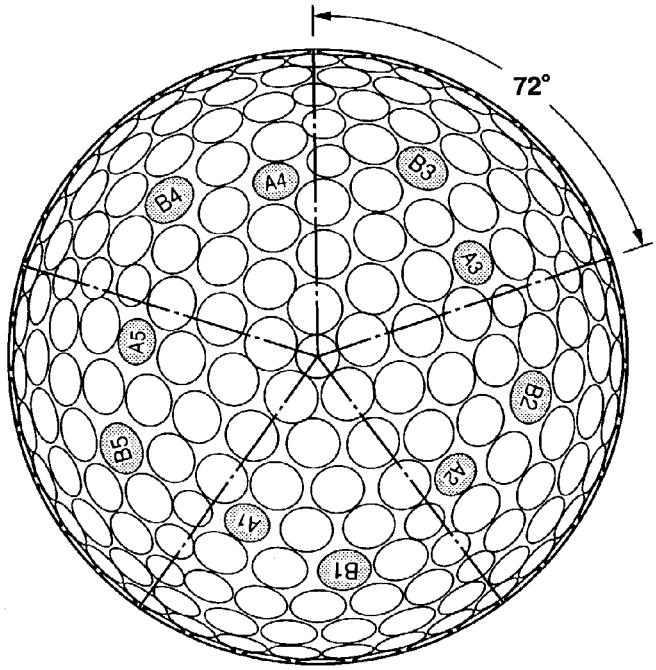
FIG. 3 is a plan view, seen from the pole side, of a golf ball according to a second embodiment of the present invention.
Figure 4:
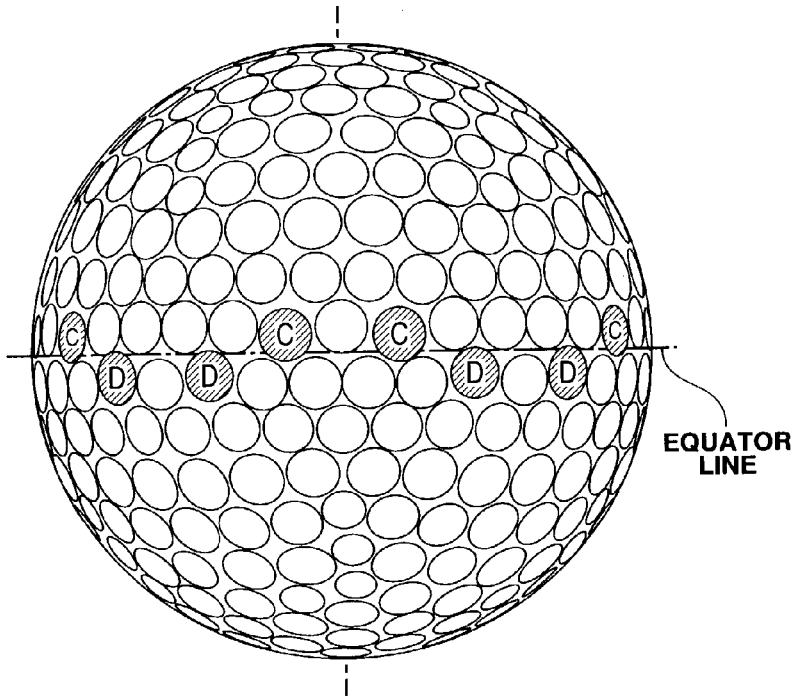
FIG. 4 is a side view, seen from the equator side, of the golf ball shown in FIG. 3.

FIG. 3 is a plan view, seen from the pole side, of a golf ball according to a second embodiment of the present invention, and FIG. 4 is a side view, seen from the equator side, of the golf ball shown in FIG. 3. In this embodiment, dimples are 72° rotation-symmetric about the rotational axis of the golf ball. For example, as shown in FIG. 3, dimples $A_1$ to $A_5$, are 72° rotation-symmetric about the rotational axis. Like the dimples $A_1$ to $A_5$, dimples $B_1$ to $B_5$ are 72° rotation-symmetric about the rotational axis, and further, dimples C and dimples D, each of which partially crosses the equator as shown in FIG. 4, are 72° rotation-symmetric about the rotational axis. In this embodiment, all of the dimples excluding the dimples located at both the poles are 72° rotation-symmetric about the rotational axis.

Figure 5:
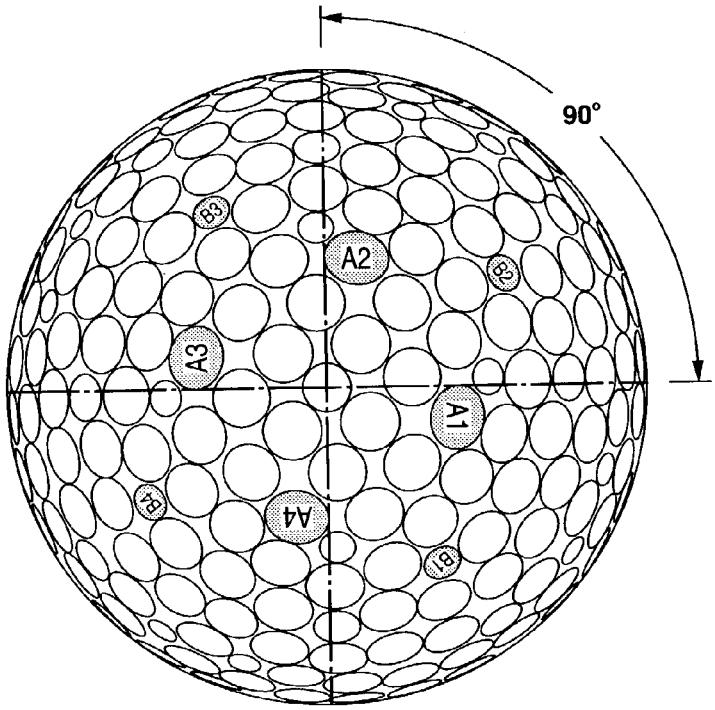
FIG. 5 is a plan view, seen from the pole side, of a golf ball according to a third embodiment of the present invention.
Figure 6:
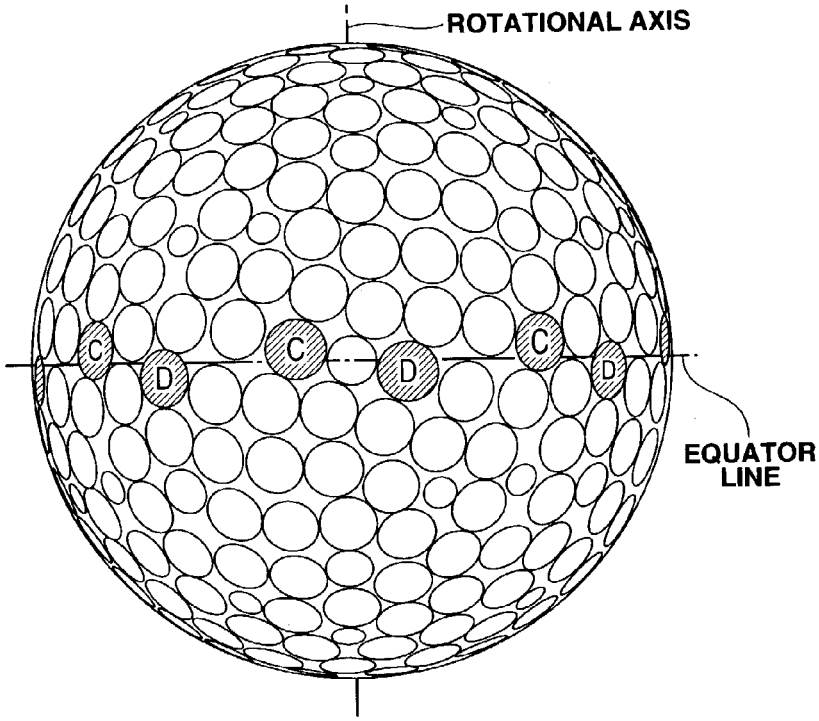
FIG. 6 is a side view, seen from the equator side, of the golf ball shown in FIG. 5.
Figure 7:
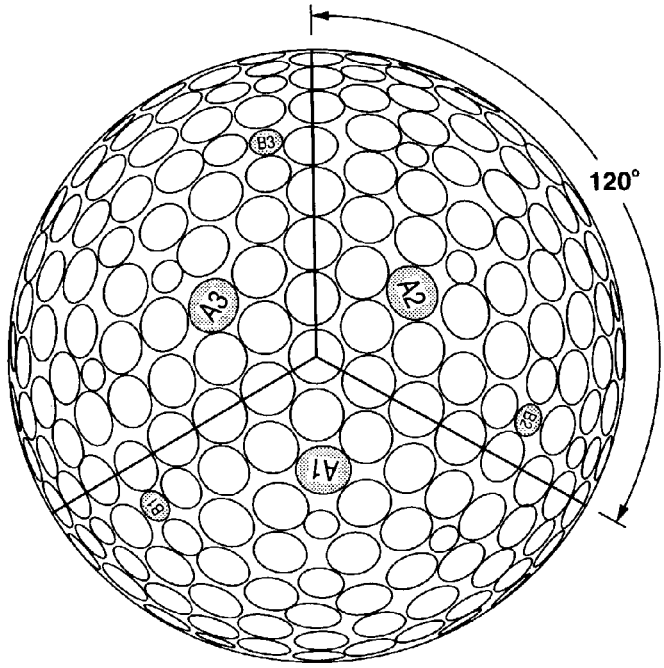
FIG. 7 is a plan view, seen from the pole side, of a golf ball according to a fourth embodiment of the present invention.
Figure 8:
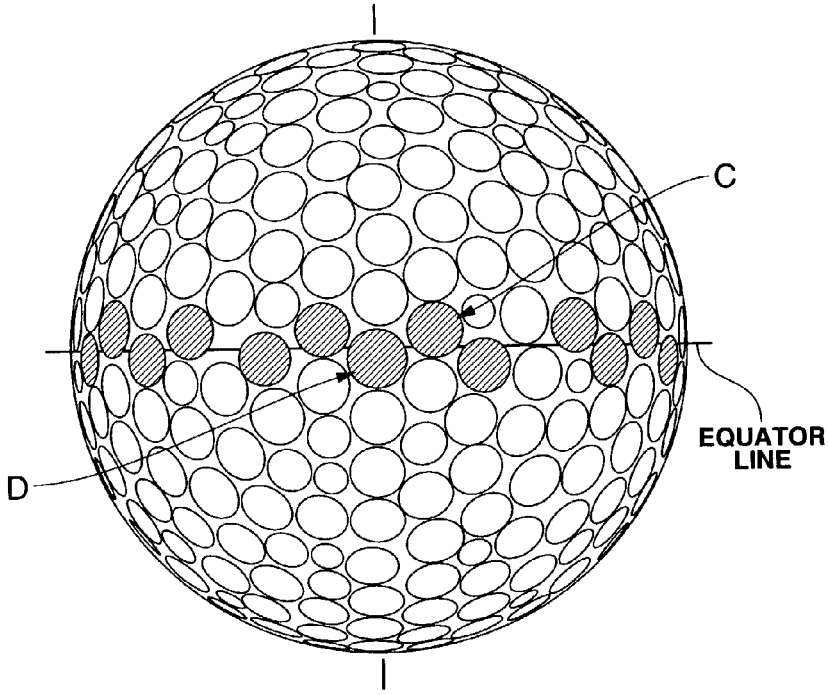
FIG. 8 is a side view, seen from the equator side, of the golf ball shown in FIG. 7.
Figure 9:
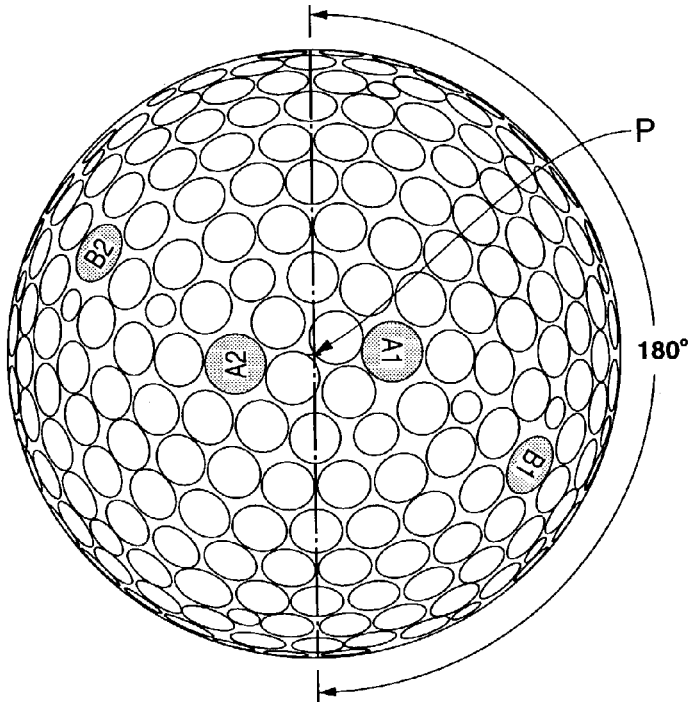
FIG. 9 is a plan view, seen from the pole side, of a golf ball according to a fifth embodiment of the present invention.
Figure 10:
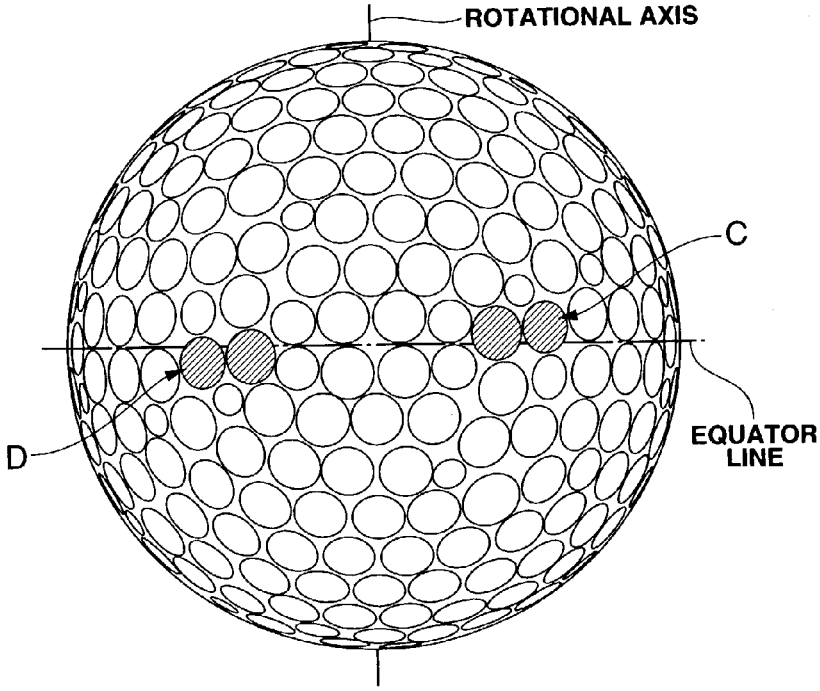
FIG. 10 is a side view, seen from the equator side, of the golf ball shown in FIG. 9.

FIGS. 5 and 6 show a golf ball according to a third embodiment of the present invention, in which a spherical surface of the ball is divided into regions by circular-arcs spaced from each other at intervals of 90°; FIGS. 7 and 8 show a golf ball according to a fourth embodiment of the present invention, in which a spherical surface of the ball is divided into regions by circular-arcs spaced from each other at intervals of 120°; and FIGS. 9 and 10 show a golf ball according to a fifth embodiment of the present invention, in which a spherical surface of the ball is divided into regions by circular-arcs spaced from each other at intervals of 180°.The detailed description of these embodiments are omitted.

It is to be noted that the angle between the adjacent circular-arcs for forming each region on the spherical surface of the ball, which is exemplified by 60°, 72°, 90°, 120°, or 180° in each of the first, second, third, fourth, and fifth embodiments, is not limited thereto but may be variously selected.

Figure 11:
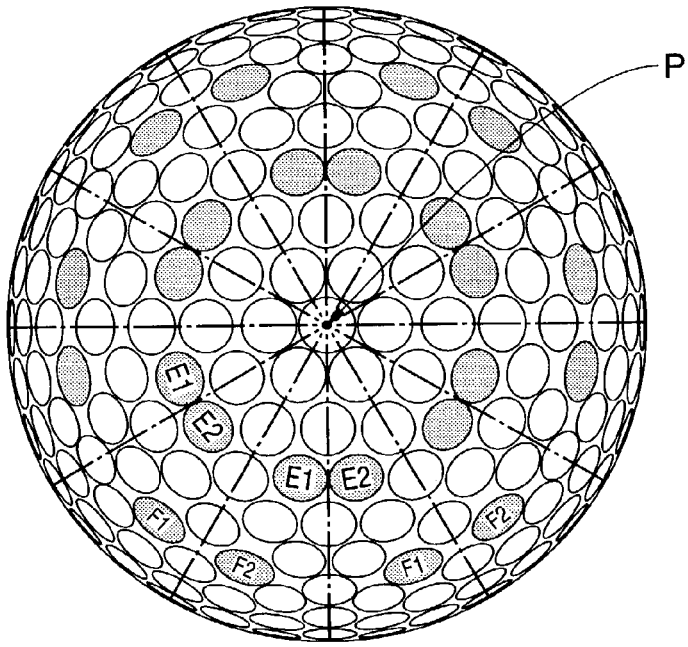
FIG. 11 is a plan view, seen from the pole side, of a golf ball according to a sixth embodiment of the present invention.
Figure 12:
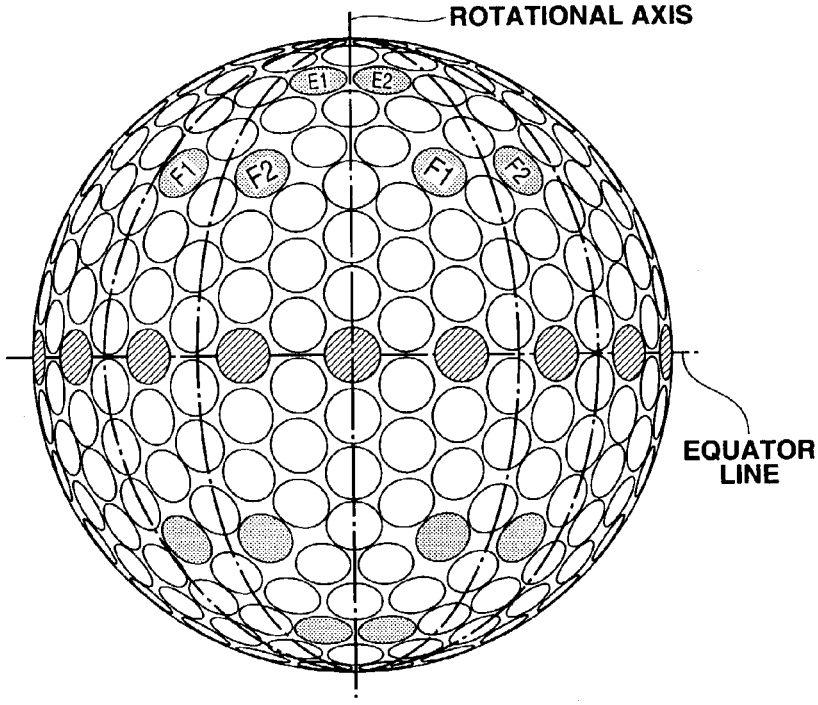
FIG. 12 is a side view, seen from the equator side, of the golf ball shown in FIG. 11.

FIG. 11 is a plan view, seen from the pole side, of a golf ball according to a sixth embodiment of the present invention, and FIG. 12 is a side view, seen from the equator side, of the golf ball shown in FIG. 11.

In this embodiment, the dimple arrangement is specified as follows: namely, assuming that circular-arcs are virtually depicted as longitude line portions extending from each of the poles to the equator line of the golf ball, a plurality of dimples are arranged in such a manner as to be linear-symmetric with respect to each of the circular-arcs.

To be more specific, according to the embodiment shown in FIGS. 11 and 12, the hemispherical surface of the ball is divided into twelve regions by the above circular arcs arranged so as to be 30° rotation-symmetric about the rotational axis. In this case, referring to FIG. 11, assuming that the circular-arc extending downwardly from the pole of the ball is taken as the vertical circular-arc and the circular-arc shifted leftwardly from the vertical circular-arc by 30° is taken as the adjacent left circular-arc, a pair of a dimple E1 and a dimple E2 located in the regions on the left and right sides of the vertical circular-arc are linear-symmetry and close to each other with respect to the vertical circular-arc, whereas another pair of the above dimple E1 and a dimple E2 which is located in the region on the left side of the adjacent left circular-arc are linear-symmetric and apart from each other with respect to the adjacent left circular-arc. In this way, pairs of the dimples E1 and E2, located along the same latitude line, are arranged in such a manner as to be linear-symmetric and alternately close to and apart from each other with respect to the circular-arcs arranged so as to be 30° rotation-symmetric about the rotational axis.

Similarly, pair of dimples F1 and F2, which are located on the same latitude line largely apart from the pole toward the equator, are arranged in such a manner as to be linear-symmetric and alternately close to and apart from each other with respect to the circular-arcs arranged so as to be 30° rotation-symmetric about the rotational axis.

As shown in FIG. 12, like the pairs of dimples E1 and E2 (F1 and F2) on the upper half (northern hemisphere) of the ball, pairs of dimples E1 and E2 (F1 and F2) on the lower half (southern hemisphere) of the ball are arranged in such a manner as to be linear-symmetric and alternately close to and apart from each other with respect to the above-described circular-arcs.

In this embodiment, as shown in FIG. 12, dimples located on the equator line of the ball are each divided into halves by the equator line.

It is to be noted that the dimples E1 and E2 and the dimples F1 and F2 are arranged so as to keep the same rotation-symmetric relation about the rotational axis as that described in the previous embodiments.

Figure 13:
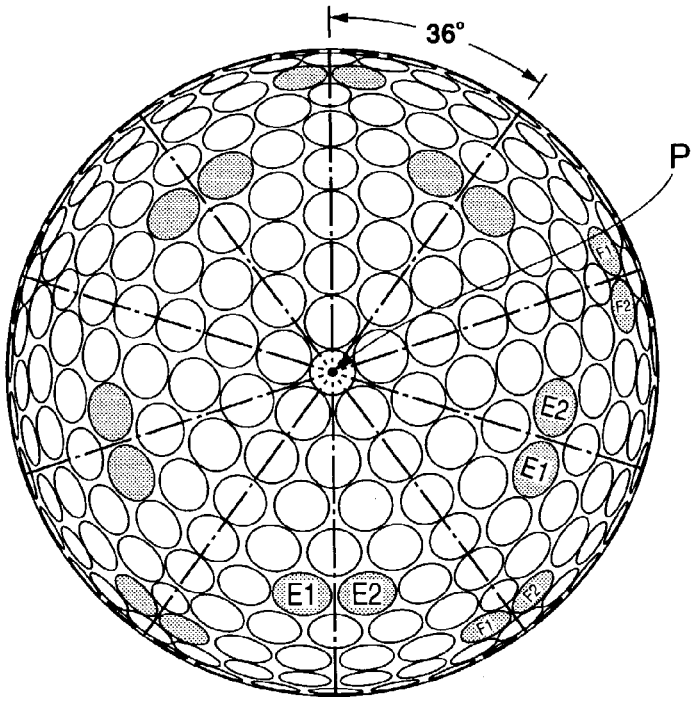
FIG. 13 is a plan view, seen from the pole side, of a golf ball according to a seventh embodiment of the present invention.
Figure 14:
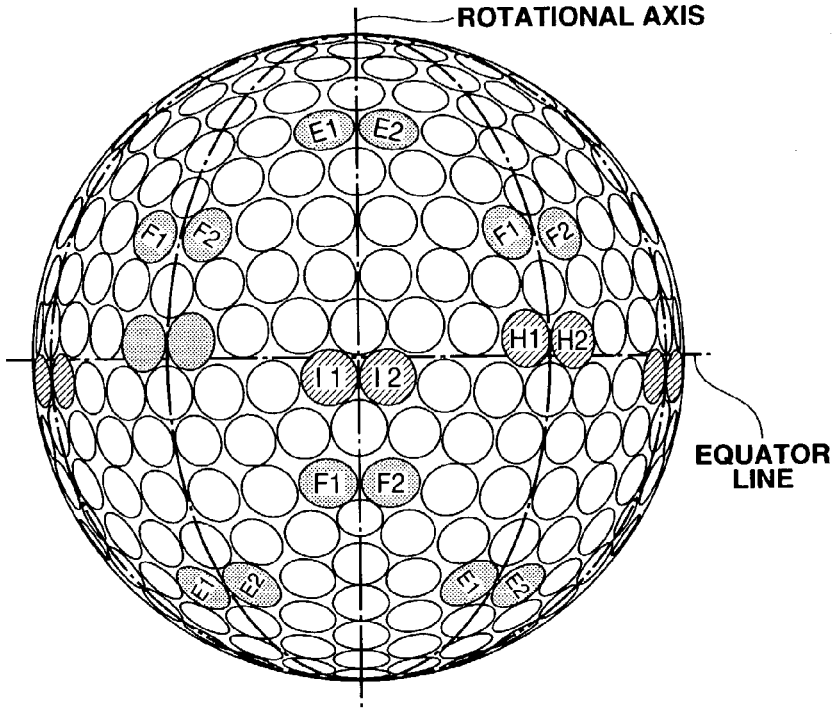
FIG. 14 is a side view, seen from the equator side, of the golf ball shown in FIG. 13.

FIG. 13 is a plan view, seen from the pole side, of a golf ball according to a seventh embodiment of the present invention, and FIG. 14 is a side view, seen from the equator side, of the golf ball shown in FIG. 13.

In this embodiment, circular-arcs are arranged in such a manner as to be 36° rotation-symmetric about the rotational axis, and for example, pairs of dimples E1 and E2 located along the same latitude line (not shown), and pairs of dimples F1 and F2 located along the same latitude line (not shown) slightly offset from the latitude line for the dimples E1 and E2 toward the equator line are arranged in such a manner as to be linear-symmetric and alternately close to and apart from each other with respect to the circular-arcs.

Similarly, pairs of dimples H1 and H2, and I1 and I2, each of which partially crosses the equator of the ball, are arranged in such a manner as to be linear-symmetric and alternately close to and apart from each other with respect to the circular-arcs arranged so as to be 36° rotation-symmetric about the rotational axis.

In this embodiment, the phase of the dimple arrangement on the southern hemisphere of the ball is shifted by 36° in the latitudinal direction from the phase of the dimple arrangement on the northern hemisphere of the ball.

Figure 15:
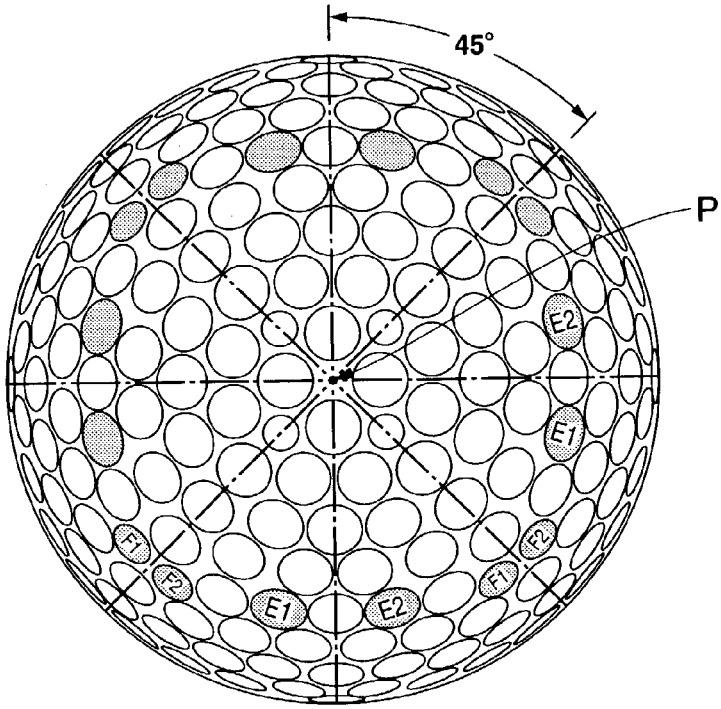
FIG. 15 is a plan view, seen from the pole side, of a golf ball according to an eighth embodiment of the present invention.
Figure 16:
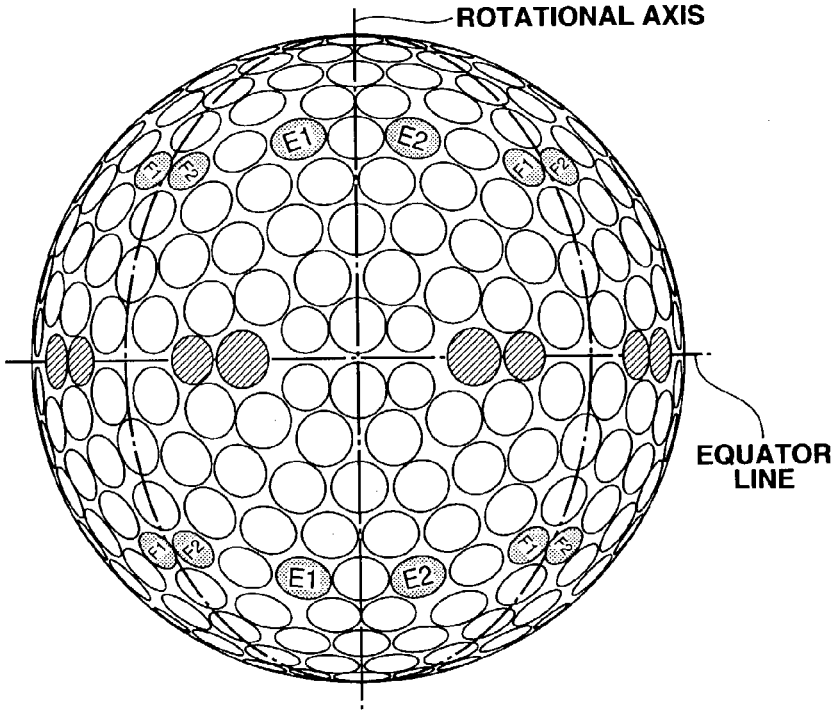
FIG. 16 is a side view, seen from the equator side, of the golf ball shown in FIG. 15.

FIG. 15 is a plan view, seen from the pole side, of a golf ball according to an eighth embodiment of the present invention, and FIG. 16 is a side view, seen from the equator side, of the golf ball shown in FIG. 15.

In this embodiment, circular-arcs are arranged in such a manner as to be 45° rotation-symmetric about the rotational axis, and for example, pairs of dimples E1 and E2 located along the same latitude line (not shown), and pairs of dimples F1 and F2 located along the same latitude line (not shown) slightly offset from the latitude line for the dimples E1 and E2 toward the equator line are arranged in such a manner as to be linear-symmetric and alternately close to and apart from each other with respect to the circular-arcs.

Like the sixth embodiment, dimples located on the equator line of the ball are each divided into halves by the equator line.

In this embodiment, the dimple arrangement on the northern hemisphere of the ball and the dimple arrangement on the southern hemisphere of the ball are linear-symmetric with respect to the equator line.

Figure 17:
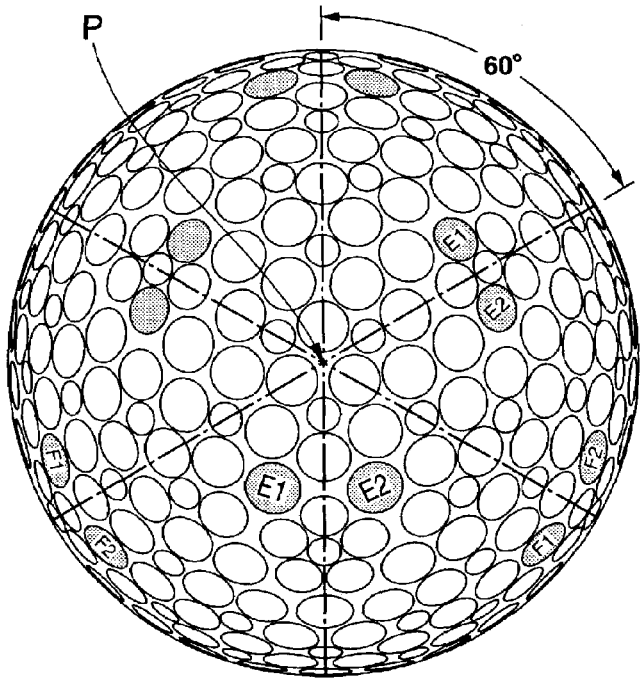
FIG. 17 is a plan view, seen from the pole side, of a golf ball according to a ninth embodiment of the present invention.
Figure 18:
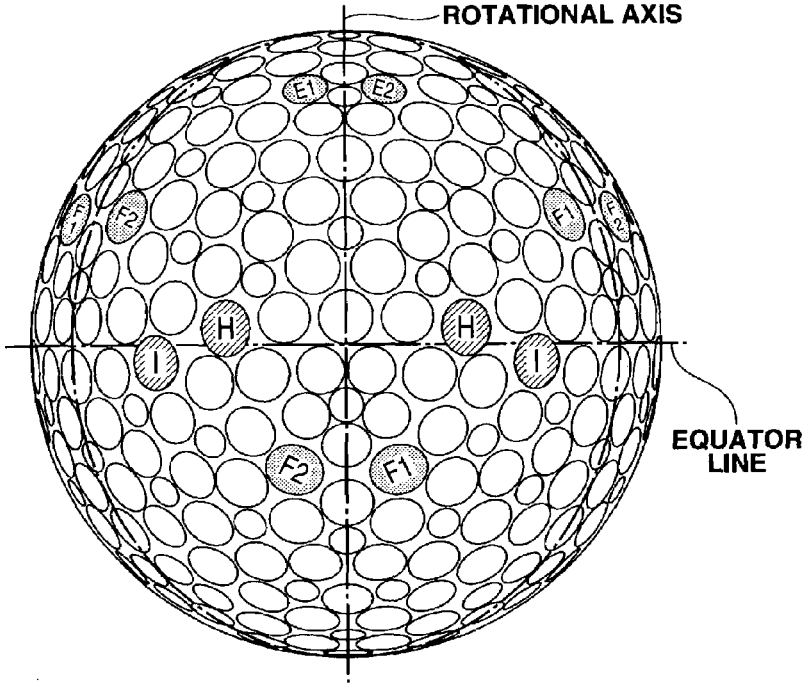
FIG. 18 is a side view, seen from the equator side, of the golf ball shown in FIG. 17.

FIG. 17 is a plan view, seen from the pole side, of a golf ball according to a ninth embodiment of the present invention, and FIG. 18 is a side view, from the equator side, of the golf ball shown in FIG. 17.

In this embodiment, circular-arcs are arranged in such a manner as to be 60° rotation-symmetric about the rotational axis, and for example, pairs of dimples E1 and E2 and pairs of dimples F1 and F2 are arranged in such a manner as to be linear-symmetric and alternately close to and apart from each other with respect to the circular-arcs.

Dimples H and I, each of which partially crosses the equator line, are uniformly divided by the equator line.

Figure 19:
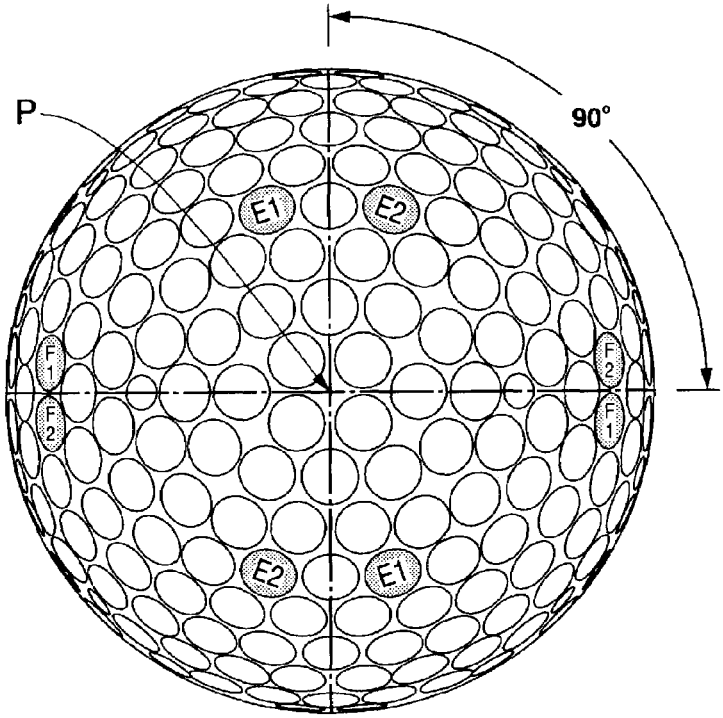
FIG. 19 is a plan view, seen from the pole side, of a golf ball according to a tenth embodiment of the present invention.
Figure 20:
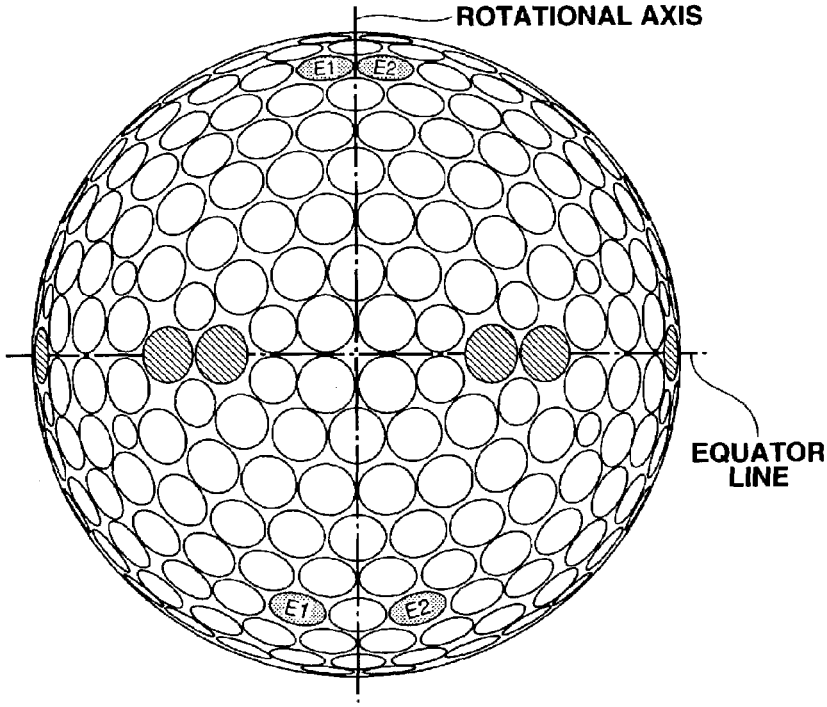
FIG. 20 is a side view, seen from the equator side, of the golf ball shown in FIG. 19.

FIG. 19 is a plan view, seen from the pole side, of a golf ball according to a tenth embodiment of the present invention, and FIG. 20 is a side view, seen from the equator side, of the golf ball shown in FIG. 19.

In this embodiment, circular-arcs are arranged in such a manner as to be 90° rotation-symmetric about the rotational axis, and for example, pairs of dimples E1 and E2 and pairs of dimples F1 and F2 are arranged in such a manner as to be linear-symmetric.

Like the sixth embodiment, dimples located on the equator line of the ball are each divided into halves by the equator line.

In this embodiment, the dimple arrangement on the northern hemisphere of the ball and the dimple arrangement on the southern hemisphere of the ball are linear-symmetric with respect to the equator line.

The configuration of the golf ball of the present invention is not limited to that described in each of the first to tenth embodiments. For example, with respect to the golf ball of the present invention, the angle for symmetry about the rotational axis, the phase angles of the northern hemisphere and the southern hemisphere, the kind and number of the dimples, and the arrangement pattern of the dimples may be suitably selected.

According to the present invention, one kind of dimples, or two to six kinds of dimples different in diameter and/or depth may be provided. In this case, the diameter of the dimple may be in a range of 2 to 5 mm, and the depth of the dimple be in a range of 0.07 to 0.25 mm. The dimples are required to be arranged in such a manner that any great circle line not crossing any one of the dimples is not present.

In the case of using a two-divided mold for forming a golf ball, since any projection for forming a dimple is generally not formed on the mold parting plane, any dimple is not present on an equator line (one of the great circle lines) of the golf ball formed by a golf ball cover material in a cavity of the mold. On the contrary, according to the present invention, since any great circle line not crossing any one of dimples is not present, at least one of the dimples is present on the equator line of the ball corresponding to the mold parting plane.

A ratio of a dimple occupied area (total area of dimples) of a golf ball to the entire surface area of a spherical surface of a virtual ball which is the same as the golf ball except that any dimple is not present on the surface of the virtual ball is preferably in a range of 65 to 85%. The golf ball in which the ratio of a dimple occupied area is specified within the above-described range is effective to sufficiently increase the flight distance. It is to be noted that the dimple occupied area can be obtained by calculating, as one dimple area, the area of a circle surrounded by the edge at which the dimple crosses a land portion of the golf ball, and multiplying the one dimple area by the total number of the dimples.

A dimple total volume, which is calculated by multiplying a dimple volume formed under a plane surrounded by the edge of one dimple by the total number of the dimples, is preferably in a range of 280 to 400 $mm^3$. If the dimple total volume is less than 280 $mm^3$ or more than 400 $mm^3$, the trajectory of the ball after being hit with a driver or the like tends to become too high or too low, thereby failing to obtain a desirable trajectory form of the ball.

According to the present invention, the number of the dimples arranged on the equator line of the ball (which dimples include not only those each of which is divided into halves but also those each of which is set such that more than a half of the dimple projects over the equator line into the other hemisphere) is preferably in a range of 4 to 32. The depth of each of dimples arranged on the equator line of the ball, or arranged near the equator line, more specifically, in a range spread upwardly and downwardly from the equator line by 30°, is preferably larger than the depth of each of dimples arranged on the other regions by an amount of 5 to 60 μm. As a result, the volume of each of the dimples arranged on the equator line or near the equator line becomes larger than that of each of the dimples arranged in the other regions by 2 to 30%. One of the reasons why the dimples on the equator line or near the equator line are made deeper than the dimples in the other regions is to prevent an inconvenience that since burrs of a cover molding material cured in injection gates on the mold parting plane equivalent to the equator line are removed by polishing, the depths of the dimples arranged along the equator line tend to become shallow.

The shape of each of dimples used for the present invention is not particularly limited insofar as it does not change the gist of the present invention, and may be selected from a circular shape, an elliptic shape, a polygonal shape, a rhombic shape, and a combination thereof.

The golf ball of the present invention is characterized in arrangement of dimples formed on the surface of the ball, and is not particularly limited in terms of kind, structure, material, and the like of the ball. For example, the golf ball of the present invention may be configured as a one-piece solid golf ball composed of a single elastic material, a two-piece solid golf ball formed by using a core made from an elastic material such as a rubber at a center portion and covering the core with a resin cover made from an ionomer resin or polyurethane, a multi-piece solid golf ball having a three or more layer structure in which an intermediate layer composed of a single layer or two or more layers is interposed between a core and a cover, or a wound golf ball.

In the case of producing the golf ball of the present invention, a known two-divided mold can be used, especially, for injecting-molding a cover material. The two-divided mold has a spherical cavity having an inner wall surface provided with a multiplicity of projections for forming dimples on the surface of a golf ball. An equator plane of the golf ball formed in the spherical cavity of the mold is equivalent to a parting plane of the mold.

For example, the golf ball shown in FIG. 2 has the dimples C projecting from the northern hemispherical side to the southern hemispherical side and the dimples D projecting from the southern hemispherical side to the northern hemispherical side, and therefore, a mold for producing such a golf ball is provided with projections for forming these dimples C and D, wherein such projections extend from the northern hemispherical side to the southern hemispherical side and vice versa. In this case, the projections partially extend from the northern hemispherical side to southern hemispherical side and vice versa, and the extended portions, which are curved in projections and recesses, are formed on the mold parting plane. In this way, the extended portions of the projections, corresponding to the extended portions of the dimples C and D, are formed in projections and recesses on the parting plane of the mold for producing the golf ball shown in FIG. 2, with the other portion corresponding to the equator region of the ball being formed in straight line along the equator line on the mold parting plane.

Even in the golf ball having the dimple arrangement shown in FIG. 12, as described above, the parting plane of the mold for producing the ball has projections and recesses for allowing the dimples to be divided into halves on the equator line of the ball.

In addition, the extended amount of each projection for forming the dimple located on the equator line is preferably in a range of 10 to 50% of the diameter of the dimple on the basis of the equatorial plane.

The cover material to be injection-molded by using the above-described mold may be any cover resin material known in the art.

In addition, injection gates of the number of 4 to 20, each of which has a cross-section in a range of 0.2 to 2.0 $mm^2$, may be provided for the mold in such a manner as to be connected to a portion on the equator line of the cavity while being radially arranged toward the center of cavity.

With respect to the golf ball (finished product) of the present invention, a distortion generated at the time of increasing a load applied to the ball placed on a flat plate from 98 N (10 kgf) to 1275 N (130 kgf) is preferably in a range of 2.4 to 3.5 mm.

With respect to the golf ball of the present invention, the C.O.R (Coefficient of Restitution) value at an incident speed of 43 m/s is preferably in a range of 0.77 to 0.83. The C.O.R value is measured as follows: namely, at the time of making a golf ball collide with a steel plate (not deformable against collision with the ball), a ratio of the speed of the ball after collision to the speed (incident speed) of the ball before collision is measured as the C.O.R value. The C.O.R value of the golf ball closer to 1 means the higher resilience of the golf ball.

The golf ball of the present invention configured as described above is excellent in flight distance and flight uniformity.

EXAMPLE

The present invention will be described in more detail with reference to the following examples, although not limited thereto.

Examples 1 to 10, Comparative Example 1

Each of golf balls in Examples 1 to 10 and Comparative Example 1 was of a three-layer solid structure including a core made from a single rubber layer, an intermediate layer made from a composition mainly containing an ionomer resin to which an olefin based elastomer is added, and a cover made from a polyurethane elastomer. For each of the golf balls in Examples 1 to 10 and Comparative Example 1, the thickness of the intermediate layer was 1.65 mm, the Shore D hardness of the intermediate layer measured on the spherical surface of the ball was 61, the thickness of the cover was 1.5 mm, and the Shore D hardness of the cover measured at a land portion of the spherical surface of the ball was 58.

Figure 21:
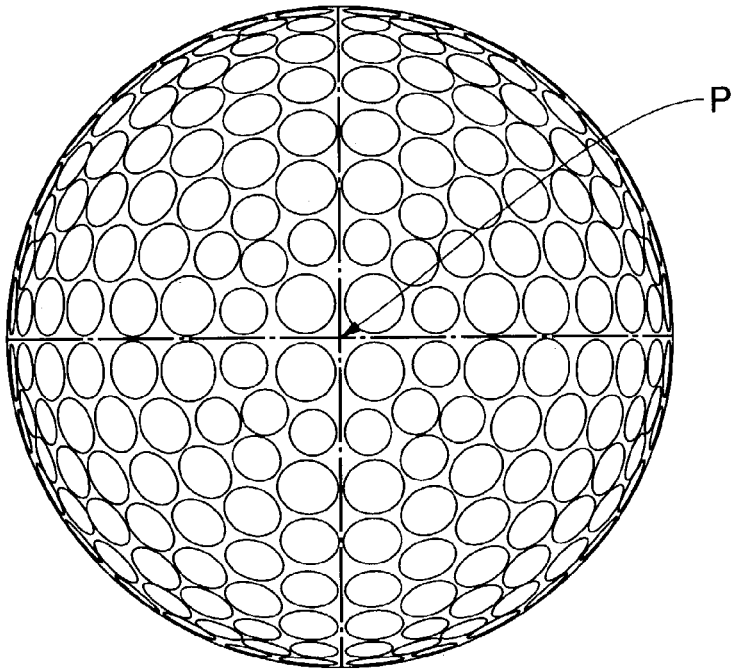
FIG. 21 is a plan view, seen from the pole side, of a golf ball according to a comparative example of the present invention.
Figure 22:
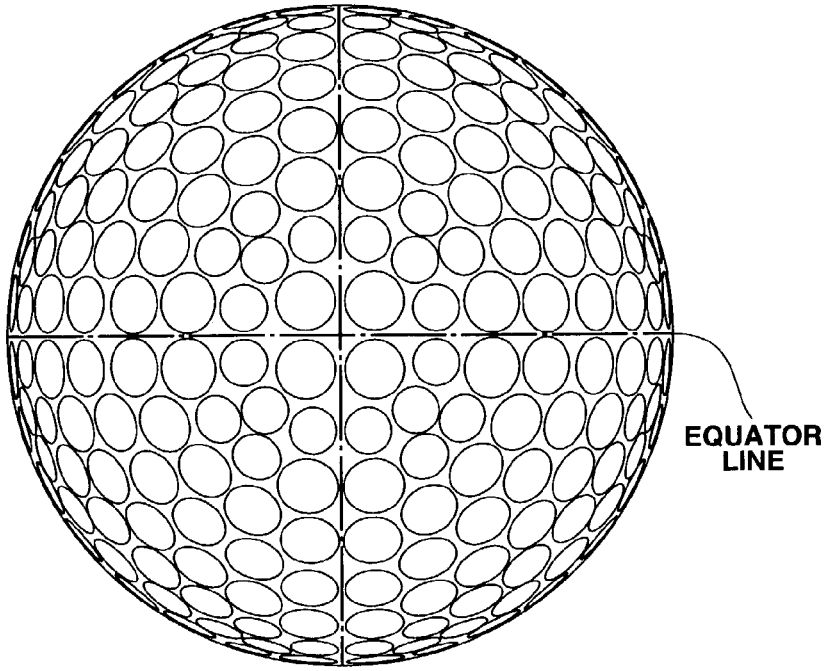
FIG. 22 is a side view, seen from the equator side, of the golf ball shown in FIG. 21.

With respect to dimple arrangements of the golf balls in Examples 1 to 10 and Comparative Example 1, the dimple arrangements described in the first to tenth embodiments were used as the dimple arrangements in Examples 1 to 10 respectively, and a dimple arrangement shown in FIG. 21 (plan view) and FIG. 22 (side view) was used as the dimple arrangement in Comparative Example 1.

The dimple arrangement shown in FIGS. 21 and 22 is a regular octahedral dimple arrangement, in which any one of dimples is not present on each of three great circles running so as to divide the spherical surface of the ball into eight triangular units, and therefore, the three great circles form the three endless land portions with no dimple.

Dimple structures used in Examples 1 to 10 and Comparative Example 1 are shown in Table 1.

Each of the golf balls in Examples 1 to 10 and Comparative Example 1 was tested in terms of flight performance and flight uniformity in accordance with the following manners.

In the test for the flight performance, each of the balls was hit by ten times at an initial speed of 67 m/s and a launch angle of 10° with a driver (W#1) attached to a hitting machine, and the average values of the carry (m) and the total distance (m) were measured. The results are shown in Table 2.

In the test for the flight uniformity, each of the golf balls was hit by ten times under the same condition as that for the test for the flight performance, and a variation in elevation angle (difference between the maximum angle and minimum angle) was measured as the uniformity of the trajectory of the ball. The ball exhibiting a variation in elevation angle within 0.3° was regarded as being excellent in uniformity, and was evaluated with a mark (○). The results are shown in Table 2.

TABLE 1

| Kind of structure | Kind of dimples | Diameter (mm) | Depth (mm) | Number (pieces) | | Total volume ($mm^3$) | Area occupied ratio (%) |
|---|---|---|---|---|---|---|---|
| a | 1 | 3.90 | 0.160 | 326 | 422 | 330 | 79.00 |
| | 2 | 3.30 | 0.140 | 48 | | (0.812) | |
| | 3 | 2.50 | 0.100 | 48 | | | |
| b | 1 | 3.95 | 0.170 | 80 | 412 | 338 | 78.40 |
| | 2 | 3.80 | 0.160 | 220 | | (0.831) | |
| | 3 | 3.55 | 0.150 | 70 | | | |
| | 4 | 3.10 | 0.130 | 42 | | | |
| c | 1 | 3.20 | 0.130 | 22 | 382 | 336 | 77.58 |
| | 2 | 4.00 | 0.165 | 328 | | (0.827) | |
| | 3 | 2.35 | 0.100 | 32 | | | |
| d | 1 | 3.20 | 0.120 | 42 | 398 | 304 | 77.10 |
| | 2 | 3.90 | 0.150 | 278 | | (0.474) | |
| | 3 | 2.50 | 0.100 | 30 | | | |
| | 4 | 4.00 | 0.160 | 48 | | | |
| e | 1 | 3.90 | 0.160 | 334 | 394 | 331 | 78.00 |
| | 2 | 3.20 | 0.140 | 20 | | (0.813) | |
| | 3 | 2.50 | 0.100 | 28 | | | |
| | 4 | 4.30 | 0.180 | 12 | | | |
| f | 1 | 3.95 | 0.160 | 380 | 380 | 350 | 81.40 |
| | | | | | | (0.861) | |
| g | 1 | 3.95 | 0.165 | 80 | 412 | 320 | 78.90 |
| | 2 | 3.75 | 0.155 | 240 | | (0.787) | |
| | 3 | 3.55 | 0.130 | 80 | | | |
| | 4 | 3.10 | 0.120 | 12 | | | |
| h | 1 | 3.90 | 0.165 | 344 | 392 | 346 | 79.30 |
| | 2 | 3.50 | 0.140 | 40 | | (0.850) | |
| | 3 | 2.50 | 0.140 | 8 | | | |
| i | 1 | 2.50 | 0.100 | 96 | 456 | 303 | 77.36 |
| | 2 | 3.30 | 0.130 | 60 | | (0.745) | |
| | 3 | 3.70 | 0.150 | 120 | | | |
| | 4 | 3.90 | 0.160 | 180 | | | |
| j | 1 | 3.90 | 0.160 | 358 | 394 | 335 | 78.90 |
| | 2 | 3.30 | 0.140 | 16 | | (0.823) | |
| | 3 | 2.50 | 0.100 | 20 | | | |
| k | 1 | 4.00 | 0.195 | 72 | 392 | 348 | 71.80 |
| | 2 | 3.80 | 0.185 | 200 | | (0.856) | |
| | 3 | 3.15 | 0.155 | 120 | | | |

Note: The numeral in a parenthesis in the item "Total Volume" denotes a dimple volume ratio.

TABLE 2

| | | Example | | | | | | | | | | Comparative Example |
|---|---|---|---|---|---|---|---|---|---|---|---|---|
| | | 1 | 2 | 3 | 4 | 5 | 6 | 7 | 8 | 9 | 10 | 1 |
| Kind of Dimple Structure | | a | b | c | d | e | f | g | h | i | j | k |
| Flight Distance | Carry (m) | 214 | 209 | 209 | 216 | 216 | 205 | 217 | 207 | 218 | 215 | 212 |
| | Total (m) | 230 | 236 | 225 | 227 | 230 | 225 | 230 | 225 | 228 | 227 | 224 |
| Flight Uniformity | | ○ | ○ | ○ | ○ | ○ | ○ | ○ | ○ | ○ | ○ | X |

The results shown in Table 2 shows that each of the golf balls in Examples 1 to 10 exhibits a large flight distance and an excellent flight uniformity. On the contrary, for the golf ball in Comparative Example 1, a variation in elevation angle is as large as 1.0° (evaluated with a mark (X)), and therefore, the flight uniformity is insufficient.

While the preferred embodiments of the present invention have been described using the specific terms, such description is for illustrative purposes only, and it is to be understood that changes and variations may be made without departing from the spirit and scope of the following claims.

The invention claimed is:

1. A golf ball comprising:

a multiplicity of dimples on a spherical surface of said golf ball;

wherein any great circle line not crossing any one of said dimples is not present on the spherical surface of said golf ball;

said dimples crossing an equator of said golf ball as a great circle line partially cross the equator and the number of said partially crossing dimples is in a range of 4 to 32; and given that longitude lines extending from each of both poles of said golf ball to the equator are taken as virtual circular-arcs, said dimples are not linear-symmetric with respect to each of said circular-arcs;

wherein said dimples including said dimples crossing the equator are rotation-symmetric of a specific angle of 360° /n (n:natural number) about a rotational axis which connects both of the poles of said golf ball to each other while passing through a center of an equatorial plane of said golf ball, wherein a phase of a dimple arrangement on a southern hemisphere of the golf ball is not shifted in a latitudinal direction from a phase of a dimple arrangement on a northern hemisphere of the golf ball, wherein said dimples crossing the equator of said golf ball cross the equator in a range of 10 to 50% of a diameter of said dimples;

wherein a dimple total volume is a range of 280 to 350 $mm^3$;

wherein a ratio of a total area occupied by the dimples to an entire surface area of a spherical surface of a virtual ball which is the same as the golf ball except that any dimple is not present on the surface of the virtual ball, is in the range of 78.0 to 85%; and wherein a volume of each of the dimples crossing the equator or near the equator is larger than that of other dimples by 2 to 30%.

2. A golf ball according to claim 1, wherein said dimples are 60° rotation-symmetric about said rotational axis.

3. A golf ball according to claim 1, wherein said dimples are 72° rotation-symmetric about said rotational axis.

4. A golf ball according to claim 1, wherein said dimples are 90° rotation-symmetric about said rotational axis.

5. A golf ball according to claim 1, wherein said dimples are 120° rotation-symmetric about said rotational axis.

6. A golf ball according to claim 1, wherein said dimples are 180° rotation-symmetric about said rotational axis.

7. A golf ball according to claim 1, wherein a part of said dimples crossing the equator is formed, at the time of formation of said ball, by mold halves having a parting portion curved in projections and depressions along the edges of said dimples.

8. A golf ball according to claim 1, wherein substantially all of the dimples are rotation-symmetric of the specific angle about the rotational axis.

9. A golf ball according to claim 8, wherein substantially all of the dimples excluding the dimples located at both the poles are rotation-symmetric about the rotational axis.

10. A golf ball according to claim 1, wherein all of the dimples have a circular shape.

11. A golf ball according to claim 1, wherein said dimples are respectfully point-symmetric to be different from each other by 180° about the rotational axis.

12. A golf ball according to claim 1, wherein the volume of each of the dimples arranged in a range spread upwardly and downwardly from the equator line by 30° becomes larger than that of each of the dimples arranged in the other regions by 2 to 30%.

13. A golf ball according to claim 1, wherein the total number of the dimples is between 394 and 422.

14. A golf ball according to claim 1, wherein said multiplicity of dimples comprises four to six kinds of dimples which are different in diameter and/or depth.

* * * * *